US007556333B2

(12) United States Patent
Mitsuzawa

(10) Patent No.: US 7,556,333 B2
(45) Date of Patent: Jul. 7, 2009

(54) PRINTING APPARATUS HAVING APPROPRIATE CORRECTION OF FEED AMOUNT

(75) Inventor: Toyohiko Mitsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 10/686,772

(22) Filed: Oct. 17, 2003

(65) Prior Publication Data

US 2004/0135833 A1 Jul. 15, 2004

(30) Foreign Application Priority Data

Oct. 17, 2002 (JP) ..... 2002-303372

(51) Int. Cl.
*B41J 29/38* (2006.01)
*B41J 2/01* (2006.01)
*B41J 2/21* (2006.01)

(52) U.S. Cl. ..... 347/16; 347/104

(58) Field of Classification Search ..... 347/13, 347/14, 17, 19, 42, 16, 220, 43
See application file for complete search history.

(56) References Cited

U.S. PATENT DOCUMENTS 4,520,367 A * 5/1985 Ishikawa et al. ..... 347/74
4,617,580 A * 10/1986 Miyakawa ..... 346/136
4,839,674 A * 6/1989 Hanagata et al. ..... 346/136
4,975,780 A * 12/1990 Kuboki ..... 358/296
5,216,442 A * 6/1993 Parks et al. ..... 346/134
5,793,397 A * 8/1998 Barker et al. ..... 347/88
5,988,784 A * 11/1999 Takemura et al. ..... 347/8
6,116,795 A * 9/2000 Ogasawara ..... 400/582
6,158,344 A * 12/2000 Walker et al. ..... 347/16
6,196,736 B1 3/2001 Otsuki et al.
6,234,602 B1 * 5/2001 Soto et al. ..... 347/19
6,416,153 B1 * 7/2002 Pan et al. ..... 347/19
6,439,684 B1 * 8/2002 Yoshimura et al. ..... 347/19
6,450,634 B2 * 9/2002 Elgee et al. ..... 347/106

(Continued)

FOREIGN PATENT DOCUMENTS

JP 9-262992 A 10/1997

(Continued)

OTHER PUBLICATIONS

W.G. McLean and E.W. Nelson, "Impulse and Momentum," Engineering Mechanics: Statics and Dynamics, 1952, Schaum Publishing Co., 2nd edition, pp. 286.*

(Continued)

*Primary Examiner*—Matthew Luu
*Assistant Examiner*—Shelby Fidler
(74) *Attorney, Agent, or Firm*—Sughrue Mion, PLLC

(57) ABSTRACT

A printing apparatus comprises a plurality of print heads, a moving member that can be moved and that is provided with the plurality of print heads, and a feed mechanism for feeding a medium to be printed. Dots for correcting a feed amount by which the feed mechanism feeds the medium to be printed are formed on the medium to be printed by ejecting ink from a predetermined print head, among the plurality of print heads, while moving the moving member. The predetermined print head is a print head other than the print head, among the plurality of print heads, that is the most susceptible to vibration caused by moving the moving member.

16 Claims, 8 Drawing Sheets

U.S. PATENT DOCUMENTS

| | | | | |
|---|---|---|---|---|
| 6,454,474 | B1 * | 9/2002 | Lesniak et al. | 400/582 |
| 6,467,867 | B1 * | 10/2002 | Worthington et al. | 347/19 |
| 6,530,647 | B2 | 3/2003 | Kubota et al. | |
| 6,561,615 | B2 * | 5/2003 | Okawa et al. | 347/19 |
| 6,568,784 | B2 * | 5/2003 | Izumi et al. | 347/19 |
| 6,641,224 | B1 * | 11/2003 | Heck et al. | 301/13.2 |
| 6,682,171 | B2 * | 1/2004 | Otsuka | 347/43 |
| 6,769,759 | B2 * | 8/2004 | Yamasaki et al. | 347/41 |
| 6,789,872 | B2 * | 9/2004 | Ioka et al. | 347/19 |
| 6,905,186 | B2 * | 6/2005 | Kojima | 347/19 |
| 6,938,975 | B2 * | 9/2005 | King et al. | 347/16 |
| 7,083,249 | B2 * | 8/2006 | Iwao | 347/19 |
| 2002/0140794 | A1 * | 10/2002 | Asano et al. | 347/102 |

FOREIGN PATENT DOCUMENTS

| | | | |
|---|---|---|---|
| JP | 2000-158735 | | 6/2000 |
| JP | 2000-158735 | A | 6/2000 |
| JP | 2000/326554 | A | 11/2000 |
| JP | 2000326554 | A * | 11/2000 |

OTHER PUBLICATIONS

W.G. McLean and E.W. Nelson, "Impulse and Momentum", Engineering Mechanics: Statics and Dynamic, 1952, Schaum Publishing Co., 2nd edition, p. 286.

* cited by examiner

PRINTING APPARATUS HAVING APPROPRIATE CORRECTION OF FEED AMOUNT

CROSS-REFERENCE TO RELATED APPLICATION

The present application claims priority upon Japanese Patent Application No. 2002-303372 filed on Oct. 17, 2002, which is herein incorporated by reference.

BACKGROUND OF THE INVENTION

1. Field of the Invention

The present invention relates to printing apparatuses.

2. Description of the Related Art

In recent years, color inkjet printers that eject several colors of ink from a print head so as to form ink dots on print paper have become popular as output devices for computers. More recently, relatively large color inkjet printers that use a plurality of print heads to print onto print paper such as roll paper have also been achieved (for example, see JP 2000-158735A). Such color inkjet printers eject ink from the print heads while moving a carriage so as to form dots on the print paper for correcting the feed amount by which the print paper is fed by a paper feed roller.

When moving the carriage and forming dots for correcting the feed amount on the print paper, vibration occurs in the carriage. Since the print heads are provided in the carriage, that vibration is transmitted to the print heads.

Under these circumstances, when ink is ejected from the print heads to form dots for correcting the feed amount on the print paper, desired dots are not obtained, and therefore there is the possibility that correction of the feed amount cannot be carried out appropriately.

SUMMARY OF THE INVENTION

The present invention was arrived at in light of the foregoing problem, and it is an object thereof to achieve a printing apparatus with which correction of the feed amount can be carried out appropriately.

According to an aspect of the present invention, a printing apparatus comprises:

a plurality of print heads;

a moving member that can be moved and that is provided with the plurality of print heads; and a feed mechanism for feeding a medium to be printed;

wherein dots for correcting a feed amount by which the feed mechanism feeds the medium to be printed are formed on the medium to be printed by ejecting ink from a predetermined print head, among the plurality of print heads, while moving the moving member, and wherein the predetermined print head is a print head other than the print head, among the plurality of print heads, that is the most susceptible to vibration caused by moving the moving member.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
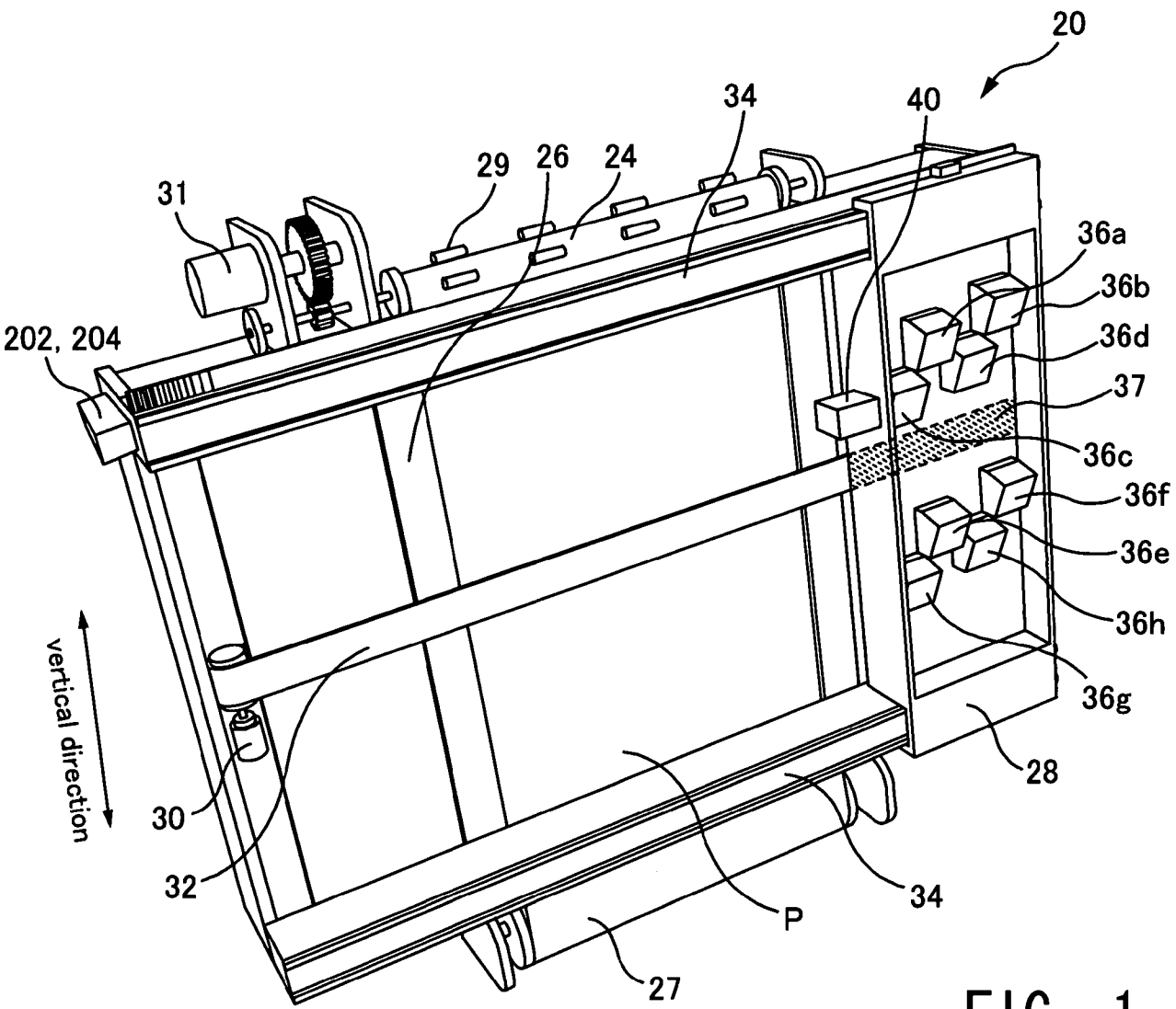
FIG. 1 is a perspective view showing an overview of a color inkjet printer 20 according to an embodiment of the present invention.

At least the following matters will be made clear by the explanation in the present specification and the description of the accompanying drawings.

According to an aspect of the present invention, a printing apparatus comprises: a plurality of print heads; a moving member that can be moved and that is provided with the plurality of print heads; and a feed mechanism for feeding a medium to be printed; wherein dots for correcting a feed amount by which the feed mechanism feeds the medium to be printed are formed on the medium to be printed by ejecting ink from a predetermined print head, among the plurality of print heads, while moving the moving member, and wherein the predetermined print head is a print head other than the print head, among the plurality of print heads, that is the most susceptible to vibration caused by moving the moving member.

It is preferable that the dots for correcting the feed amount by which the medium to be printed is fed are formed using the print head that is the least susceptible to vibration. However, it is still possible to suitably correct the feed amount by which the medium to be printed is fed even if the dots for correction are formed using a print head other than the print head that is the most susceptible to the vibration.

Further, it is possible that the predetermined print head is the print head, among the plurality of print heads, that is the least susceptible to the vibration caused by moving the moving member.

By adopting the print head, among the plurality of print heads, that is least likely to be susceptible to vibration caused by moving the moving member as the predetermined print head, correction of the feed amount can be carried out more appropriately.

Further, it is possible that the printing apparatus further comprises a drive member that is connected to the moving member and that is for driving the moving member; and the predetermined print head is the print head that is located the closest to a connecting section at which the moving member and the drive member are connected to each other.

Doing this allows the print head that is the least susceptible to the vibration to be more easily selected.

Further, it is possible that the dots for correcting the feed amount by which the feed mechanism feeds the medium to be printed are formed on both edge sections of the medium to be printed by ejecting ink from the predetermined print head, among the plurality of print heads, while moving the moving member.

By doing this, it is possible to find a more accurate correction amount, and therefore more appropriate correction can be implemented.

Further, it is possible that the dots for correcting the feed amount by which the feed mechanism feeds the medium to be printed are formed on the medium to be printed by ejecting ink from predetermined nozzles provided in the predetermined print head.

By doing this, there is the advantage that error due to changing the nozzles that eject ink will not occur.

Further, it is possible that the printing apparatus further comprises: a support member for supporting the medium to be printed; a suction member for sucking the medium to be printed toward the support member; and a first detector for detecting a force by which the suction member sucks the medium to be printed; and that whether or not to form, on the medium to be printed, the dots for correcting the feed amount by which the feed mechanism feeds the medium to be printed is determined according an output value of the first detector.

Doing this allows the dots for correcting the feed amount by which the medium to be printed is fed by the feed mechanism to be formed on the medium to be printed at an appropriate timing.

Further, it is possible that whether or not to form, on the medium to be printed, the dots for correcting the feed amount by which the feed mechanism feeds the medium to be printed is determined according at least one of a value of a temperature around the printing apparatus and a value of a humidity around the printing apparatus.

Doing this allows the dots for correcting the feed amount by which the medium to be printed is fed by the feed mechanism to be formed on the medium to be printed at an appropriate timing.

Further, it is possible that the dots for correcting the feed amount by which the feed mechanism feeds the medium to be printed are formed on the medium to be printed when power is supplied to the printing apparatus.

Doing this allows the implementation of appropriate correction to be assured.

Further, it is possible that the dots for correcting the feed amount by which the feed mechanism feeds the medium to be printed are formed on the medium to be printed during a printing operation of the printing apparatus.

Doing this allows the dots to be efficiently formed on the medium to be printed.

Further, it is possible that the dots for correcting the feed amount by which the feed mechanism feeds the medium to be printed are formed on the medium to be printed when the medium to be printed has been exchanged.

Doing this allows the implementation of appropriate correction to be assured.

Further, it is possible that the printing apparatus further comprises: a second detector for detecting whether or not the medium to be printed has been exchanged; and that when it has been detected by the second detector that the medium to be printed has been exchanged, the dots for correcting the feed amount by which the feed mechanism feeds the medium to be printed are formed on the medium to be printed.

In this way, whether or not the medium to be printed has been exchanged can be detected using a simple method.

Further, it is possible that the dots for correcting the feed amount by which the feed mechanism feeds the medium to be printed are formed on the medium to be printed when a print mode of the printing apparatus has been changed.

Doing this allows the implementation of appropriate correction to be assured.

Further, it is possible that at least two correction amounts for correcting the feed amount by which the feed mechanism feeds the medium to be printed are obtained based on the dots formed on the medium to be printed, and that, based on an average value of the correction amounts that are obtained, the feed amount by which the feed mechanism feeds the medium to be printed is corrected.

Doing this allows more accurate correction to be carried out.

It is also possible to achieve a printing apparatus comprising: a plurality of print heads; a moving member that can be moved and that is provided with the plurality of print heads; and a feed mechanism for feeding a medium to be printed; wherein dots for correcting a feed amount by which the feed mechanism feeds the medium to be printed are formed on both edge sections of the medium to be printed by ejecting ink from a predetermined print head, among the plurality of print heads, while moving the moving member; wherein the predetermined print head is the print head, among the plurality of print heads, that is the least susceptible to vibration caused by moving the moving member; wherein the printing apparatus further comprises a drive member that is connected to the moving member and that is for driving the moving member; wherein the predetermined print head is the print head that is located the closest to a connecting section at which the moving member and the drive member are connected to each other; wherein the printing apparatus further comprises: a support member for supporting the medium to be printed; a suction member for sucking the medium to be printed toward the support member; and a detector for detecting a force by which the suction member sucks the medium to be printed; wherein whether or not to form, on the medium to be printed, the dots for correcting the feed amount by which the feed mechanism feeds the medium to be printed is determined according an output value of the detector; and wherein whether or not to form, on the medium to be printed, the dots for correcting the feed amount by which the feed mechanism feeds the medium to be printed is determined according at least one of a value of a temperature around the printing apparatus and a value of a humidity around the printing apparatus.

In this way, most of the primary effects already mentioned can be obtained, and therefore the object of the present invention is more effectively achieved.

===Example of an Overview of a Printing Apparatus===

Figure 2:
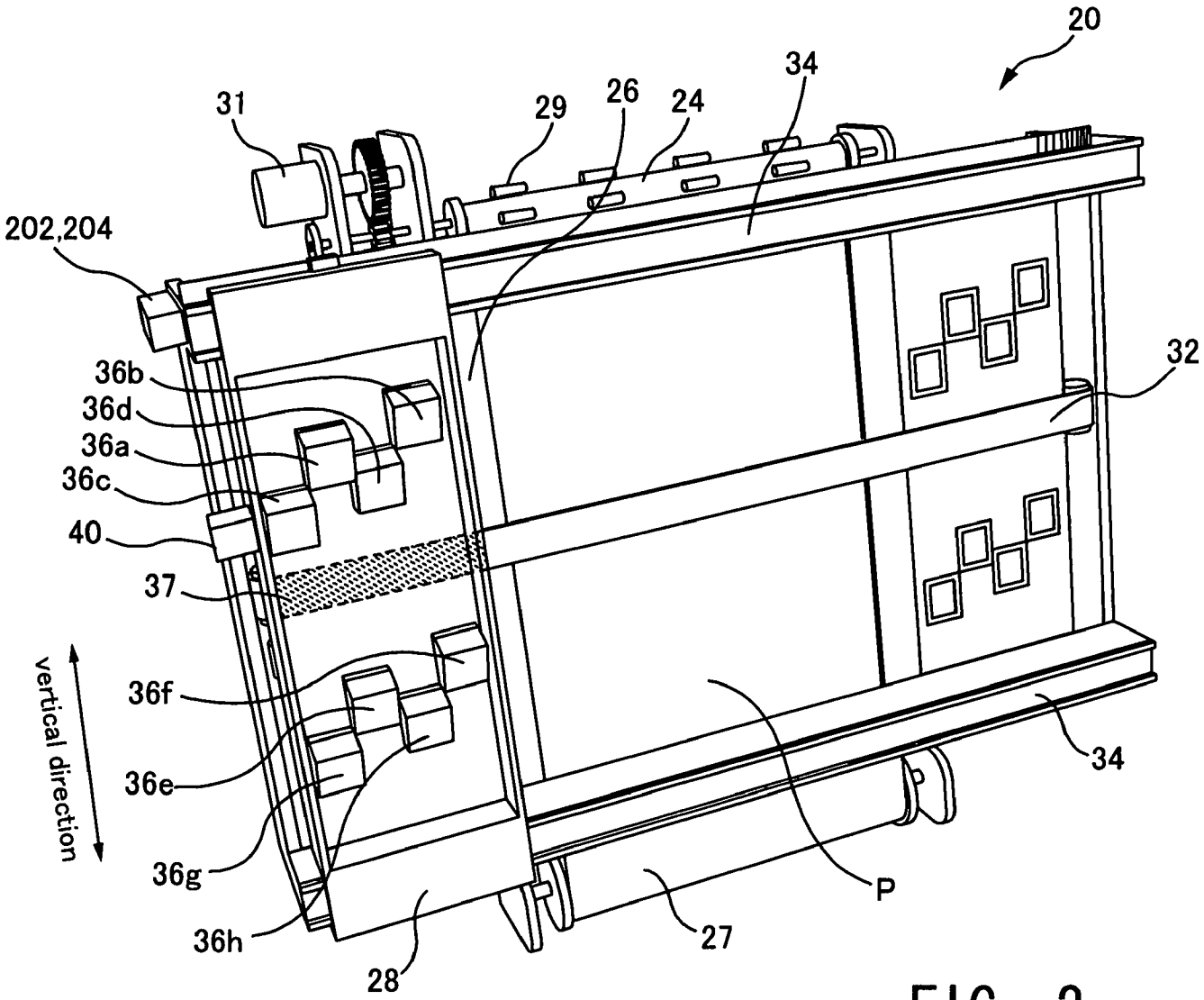
FIG. 2 is a perspective view showing an overview of the color inkjet printer 20, in which the position of a carriage 28 is different from FIG. 1, according to an embodiment of the present invention.

FIG. 1 and FIG. 2 are perspective views showing an overview of a color inkjet printer 20 serving as an example of the printing apparatus. The color printer 20 uses, for example, roll paper or relatively large-sized print paper such as JIS standard A0 sized paper or B0 sized paper, and in the example shown in FIG. 1 and FIG. 2, the color printer 20 is provided with roll paper. It should be noted that the position of the carriage, which is discussed later, is different in the color inkjet printer 20 shown in FIG. 1 and the color inkjet printer 20 shown in FIG. 2.

The color inkjet printer 20 shown in FIG. 1 and FIG. 2 is provided with a paper feed motor 31, a paper feed roller 24 (also called a "smap roller") as an example of the feed mechanism that is driven by the paper feed motor 31 and that is for feeding roll paper P, which is an example of the medium to be printed, in the paper feed direction (hereinafter, this is also called the sub-scanning direction), a roll paper holder 27 on which the roll paper P can be set, paper press rollers 29 for pressing the roll paper P against the paper feed roller 24, a platen 26 serving as an example of the support member that is capable of supporting the roll paper P, print heads 36 each provided with numerous nozzles, a carriage 28 serving as an example of the moving member that is provided with the print heads 36 and that can be moved in the main-scanning direction, a carriage motor 30, a pull belt 32 serving as an example of the drive member that is moved by the carriage motor 30, that is connected to the carriage 28 at a predetermined connecting section 37, and that is for driving the carriage 28, a guide rail 34 for guiding the carriage 28, a CCD camera 40 provided in/on the carriage 28 for capturing an image of the dots formed on the roll paper P by the ink that is ejected from the print heads 36, a temperature gauge 202 for measuring the temperature around the color inkjet printer 20, and a humidity gauge 204 for measuring the humidity around the color inkjet printer 20.

The roll paper P is set in the roll paper holder 27. The roll paper P is pressed against the paper feed roller 24 by the paper press rollers 29, and is fed in the paper feed direction over the surface of the platen 26 by rotation of the paper feed roller 24. The carriage 28 is driven by the pull belt 32 and moved in the main-scanning direction along the guide rail 34. Then, as the roll paper P is fed in the paper feed direction, the carriage 28 is moved in the main-scanning direction and ink is ejected from the plurality of print heads 36 provided in/on the carriage 28 to carry out printing.

Figure 3:
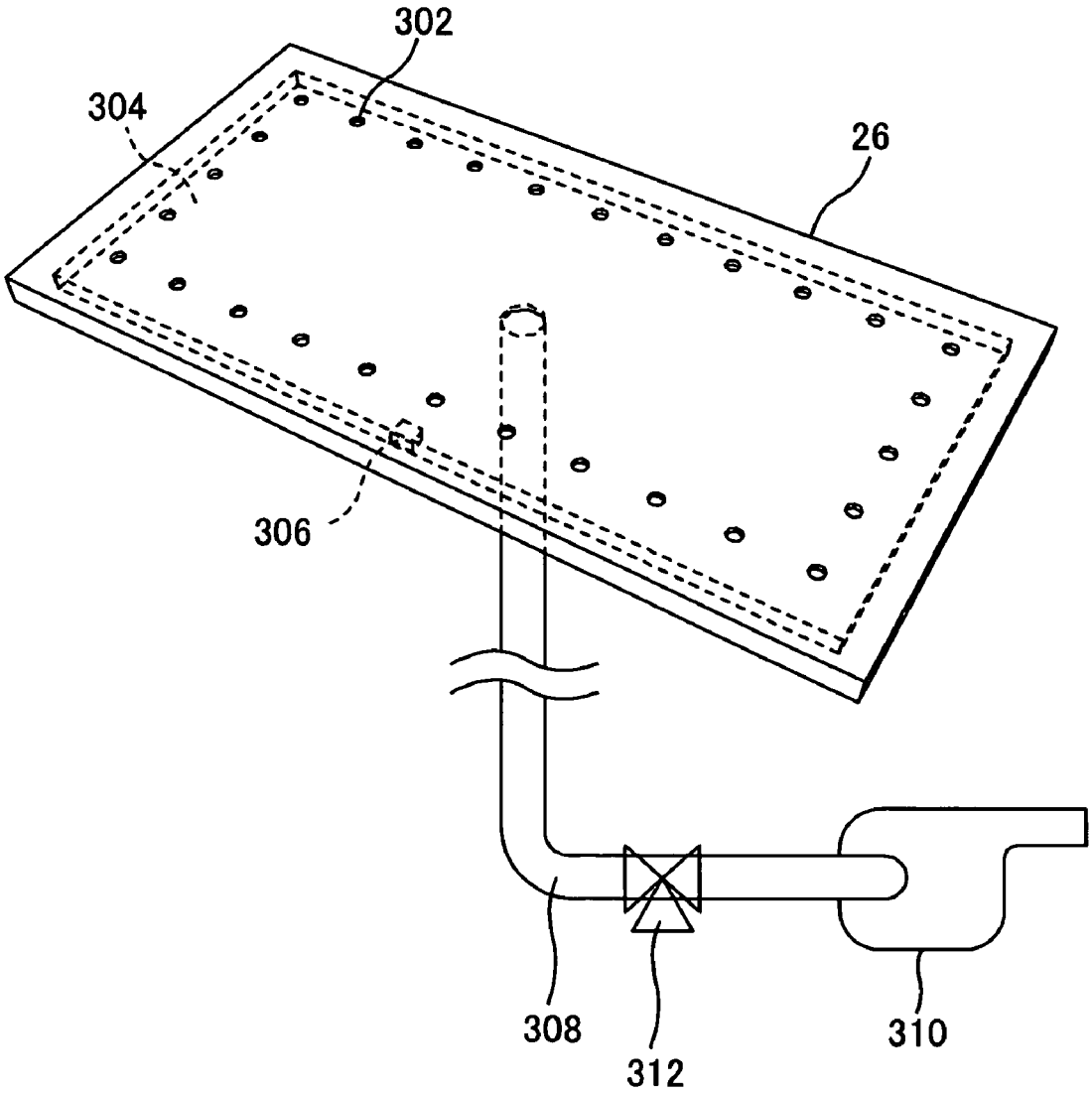
FIG. 3 is a conceptual diagram illustrating a platen 26 and a suction mechanism 16 according to an embodiment of the present invention.

Also, the platen 26, as shown in FIG. 3, has numerous suction apertures 302 in its upper surface, and is internally provided with a chamber 304 that is continuous with the suction apertures 302. FIG. 3 is a conceptual diagram illustrating the platen 26 and a suction mechanism 16, which is discussed later. The numerous suction apertures 302 are provided annularly along rim of the upper surface of the platen 26, and are in communication with the suction mechanism 16, which is an example of the suction member, via the chamber 304. The chamber 304 includes inside a pressure sensor 306, which is an example of the detector, for detecting the pressure inside the chamber 304.

The suction mechanism 16 has a suction blower 310 for sucking in the air within the chamber 304 to cause negative pressure therein and make the chamber 304 a vacuum, a hose 308 connecting the suction blower 310 and the chamber 304, and a switch valve 312 provided in the hose 308 between the suction blower 310 and the chamber 304. The switch valve 312 is constituted by an electromagnetic three-way valve that has an air release opening.

When the suction blower 310 is driven, the pressure within the chamber 304 drops, and the roll paper P supported by the platen 26 is sucked via the numerous suction apertures 302. Also, by switching the switch valve 312 in this state, atmospheric air can be released into the chamber 304.

That is, by controlling the suction blower 310 and the switch valve 312, an appropriate pressure can be established within the chamber so as to suck the roll paper P. Thus, the roll paper P can be kept flat without any bending occurring in the roll paper P.

It should be noted that in the above description, the numerous suction apertures 302 were provided annularly along the rim in the upper surface of the platen 26; however, they may also be provided at an equal spacing, for example, over the entire surface of the platen 26. This would allow the roll paper P to be adequately adhered, and has the benefit that cockling, for example, is less likely to occur.

===Configuration of the Print Heads===

Figure 4:
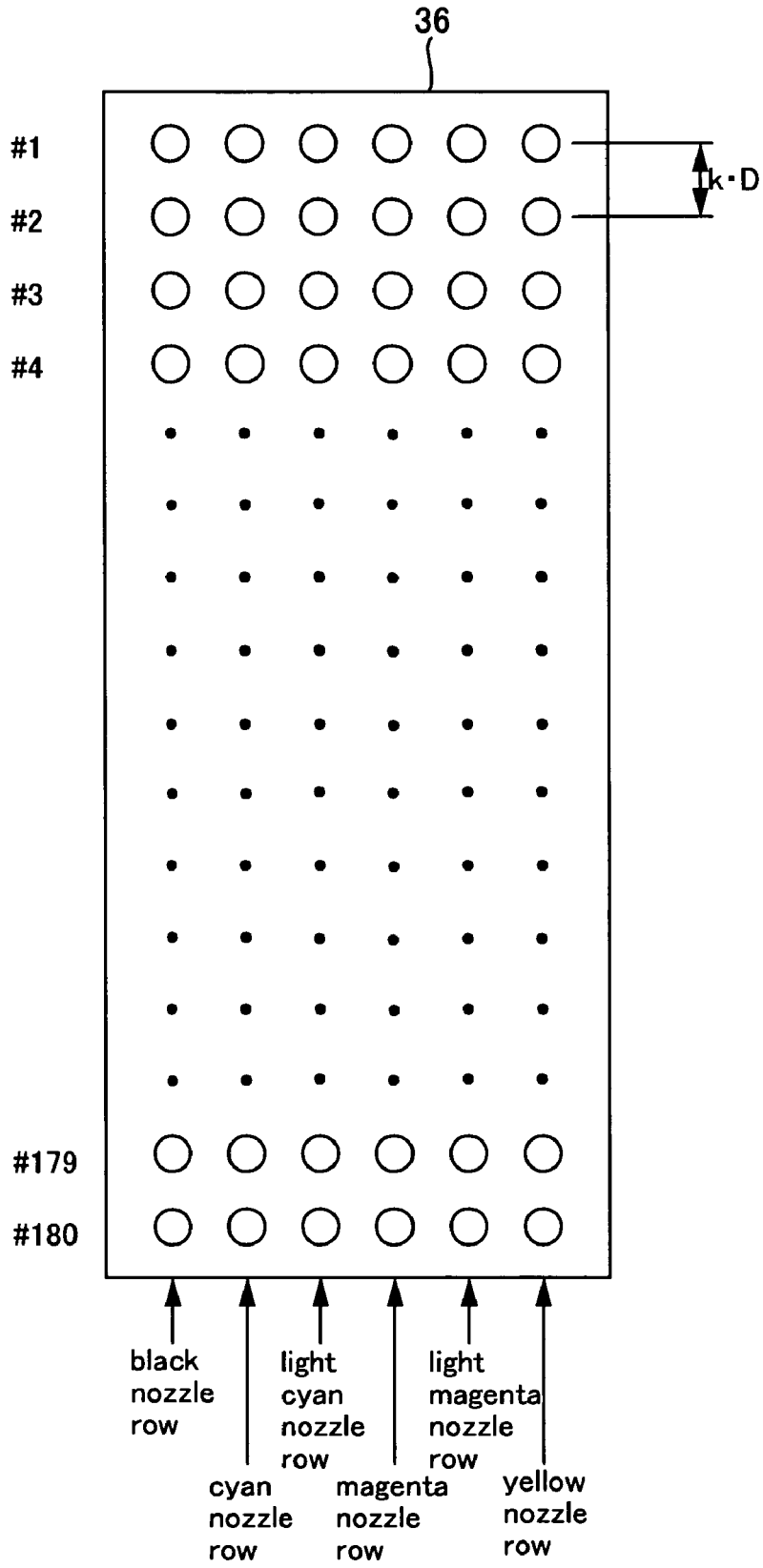
FIG. 4 is an explanatory diagram for describing print heads 36 according to an embodiment of the present invention.

Next, FIG. 4 is used to describe the configuration of the print heads 36. FIG. 4 is an explanatory diagram for describing the print heads 36.

The print head 36, as shown in FIG. 4, has a black nozzle row, a cyan nozzle row, a light cyan nozzle row, a magenta nozzle row, a light magenta nozzle row, and a yellow nozzle row, arranged in straight lines in the paper feed direction.

The black nozzle row has 180 nozzles, nozzles #1 to #180. The nozzles #1, . . . , #180 of the black nozzle row are arranged at a constant nozzle pitch k·D in the sub-scanning direction. Here, D is the dot pitch in the sub-scanning direction, and k is an integer. The dot pitch D in the sub-scanning direction is equal to the pitch of the main scan lines (raster lines), which are lines formed in the main scanning direction by dots. Hereinafter, the integer k expressing the nozzle pitch k·D is referred to simply as the "nozzle pitch k." In the example of FIG. 4, the nozzle pitch k is four dots. The nozzle pitch k, however, may be set to any integer.

The above-described matters also apply for the cyan nozzle row, the light cyan nozzle row, the magenta nozzle row, the light magenta nozzle row, and the yellow nozzle row. That is, each of these nozzle rows has 180 nozzles #1 to #180 arranged at a constant nozzle pitch k·D in the sub-scanning direction.

During printing, droplets of ink are ejected from the nozzles as the print heads 36 are moved at a constant speed in the main-scanning direction along with the carriage 28. However, depending on the print mode, there are instances in which only some of the nozzles are used and not all the nozzles are used.

It should be noted that in FIG. 4, the ink colors of the rows were, in order from the left side in the figure, the black nozzle row, the cyan nozzle row, the light cyan nozzle row, the magenta nozzle row, the light magenta nozzle row, and the yellow nozzle row; however, this is not a limitation, and it is also possible for the ink colors of the rows to be arranged in a different order.

===Example of the Overall Configuration of the Printing System===

Figure 5:
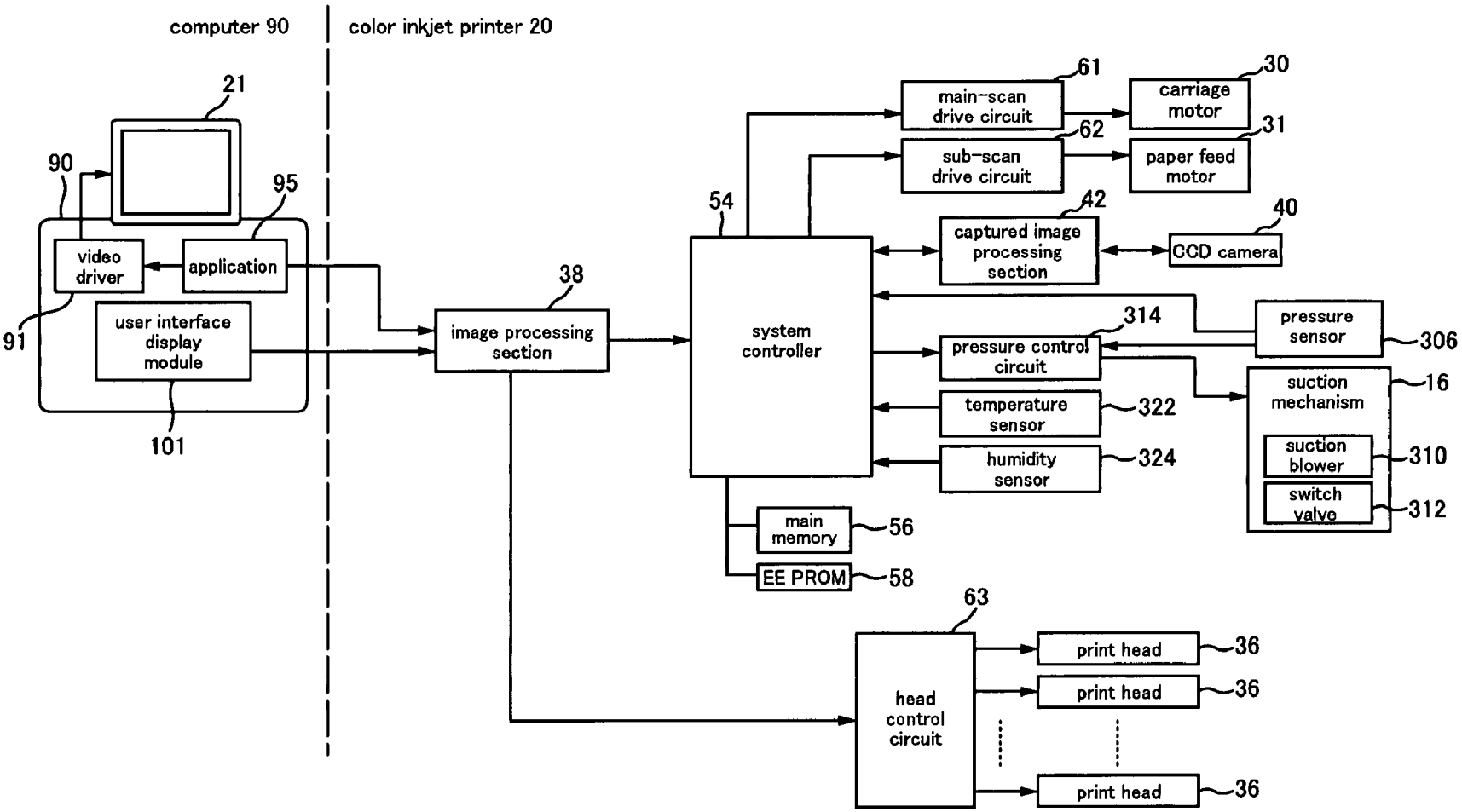
FIG. 5 is a block diagram showing the configuration of a printing system provided with the color inkjet printer 20 according to an embodiment of the present invention.
Figure 6:
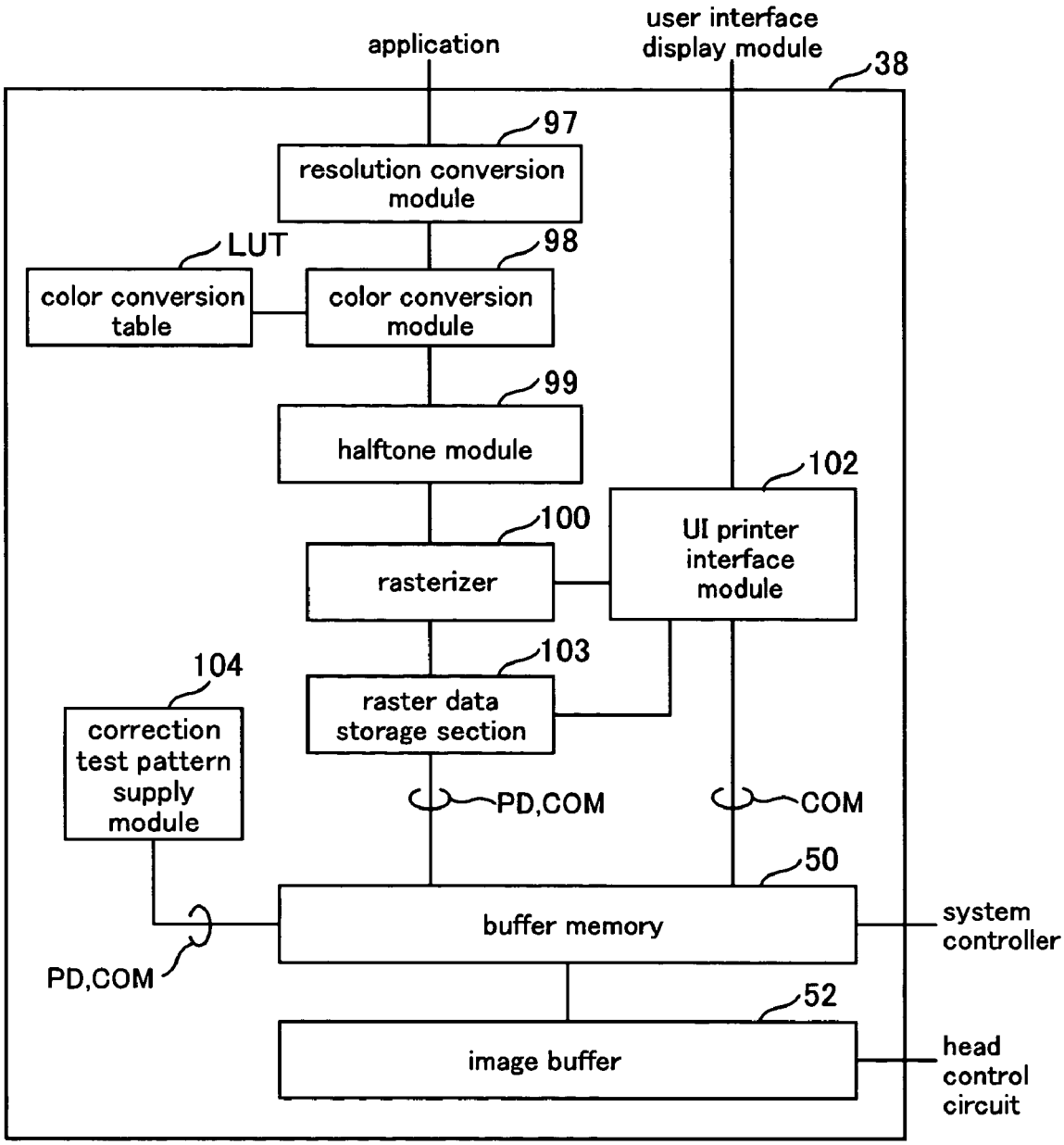
FIG. 6 is a block diagram showing the configuration of an image processing section 38 according to an embodiment of the present invention.

Next, an example of the overall configuration of the printing system is described with reference to FIG. 5 and FIG. 6. FIG. 5 is a block diagram showing the configuration of a printing system provided with the color inkjet printer 20 described above. FIG. 6 is a block diagram showing the configuration of an image processing section 38.

The printing system is provided with a computer 90 and the color inkjet printer 20, which is an example of the printing apparatus. It should be noted that the printing system including the color inkjet printer 20 and the computer 90 can also be broadly referred to as a "printing apparatus." Although not shown in the diagram, a printing system is made of the computer 90, the color inkjet printer 20, a display device such as a CRT 21 or a liquid crystal display device, input devices such as a keyboard and a mouse, and a drive device such as a flexible disk drive device or a CD-ROM drive device.

In the computer 90, an application program 95 is executed under a predetermined operating system. The operating system includes a video driver 91, and the application program 95, which is for retouching images, for example, carries out desired processing with respect to an image to be processed, and also displays the image on the CRT 21 through the video driver 91.

When the application program 95 issues a print command, the image processing section 38 provided in the color inkjet printer 20 receives image data from the application program 95 and converts the data into print data PD. As shown in FIG. 6, the image processing section 38 is internally provided with a resolution conversion module 97, a color conversion module 98, a halftone module 99, a rasterizer 100, a UI printer interface module 102, a raster data storage section 103, a color conversion lookup table LUT, a correction test pattern supply module 104, a buffer memory 50, and an image buffer 52.

The resolution conversion module 97 serves to convert the resolution of the color image data generated by the application program 95 into the print resolution. The image data whose resolution has been thus converted at this point is still image information made of the three color components RGB. The color conversion module 98 references the color conversion look-up table LUT and, for each pixel, converts the RGB image data into multi-gradation data of a plurality of ink colors that can be used by the color inkjet printer 20.

The multi-gradation data that has been color converted has a gradation value of 256 grades, for example. The halftone module 99 executes so-called halftone processing to generate halftone image data. The halftone image data are arranged by the rasterizer 100 into a desired data order, and are output as the final print data PD to the raster data storage portion 103 along with various commands COM.

Also, the correction test pattern supply module 104 has a function for outputting, to the buffer memory 50, print data PD used when executing the operation for forming, on the roll paper P, dots for correcting the feed amount by which the paper feed roller 24 feeds the roll paper P. These print data PD include raster data indicating how the dots are to be formed during each main scan and data indicating the sub-scanning feed amount.

On the other hand, the user interface display module 101 provided in the computer 90 functions to display various types of user interface windows related to printing and also functions to receive inputs from the user through these windows. For example, a user could instruct the type and size of the print paper, or the dot recording mode, for example, through the user interface display module 101.

The UI printer interface module 102 functions as an interface between the user interface display module 101 and the color inkjet printer 20. The UI printer interface module 102 interprets instructions given by the user through the user interface and sends various commands COM to the buffer memory 50, for example, or conversely, it interprets commands COM received from the buffer memory 50, for example, and executes various displays on the user interface. For example, the above-mentioned instruction regarding the type or the size of the print paper, for example, that is received by the user interface display module 101 is sent to the UI printer interface module 102, which interprets this instruction and sends a command COM to the buffer memory 50.

The UI printer interface module 102 also functions as a print mode setting section. That is, the UI printer interface module 102 determines the print mode based on information on the dot recording mode received by the user interface display module 101 and the information of the print data PD output from the rasterizer 100.

More specifically, a high image quality mode and a fast mode are provided as the dot recording modes, and the user can select either one of these modes. For example, the high image quality mode is a mode in which dots are recorded using a so-called overlapping method, and fast mode is a mode in which dots are recorded without using this method. Then, the UI printer interface module 102 determines the print mode based on the dot recording mode that has been selected and the resolution information found in the print data PD. Next, according to the print mode that has been determined, the UI printer interface module 102 outputs, to the raster data storage section 103, information about the nozzles to be use when printing and information about the data indicating the sub-scanning feed amount.

The raster data storage section 103 outputs the final print data PD to the buffer memory 50 together with various commands COM. The print data PD includes raster data indicating how dots are to be formed in each main scan, information about the nozzles to be used when printing, and the data indicating the sub-scanning feed amount.

The print data PD and the various commands COM that are output by the raster data storage section 103 and the correction test pattern supply module 104, and the commands COM output by the UI printer interface module 102, are temporarily stored in the buffer memory 50. After the color inkjet printer 20 receives these at the buffer memory 50, it transmits them to the image buffer 52 or the system controller 54. The print data PD for the plurality of colors that have been received by the buffer memory 50 are stored in the image buffer 52.

The color inkjet printer 20 is provided with a system controller 54 for controlling the overall operation of the color inkjet printer 20, a main memory 56, and an EEPROM 58, in addition to the image processing section 38 described above. The system controller 54 is connected to a main-scan drive circuit 61 for driving the carriage motor 30, a sub-scan drive circuit 62 for driving the paper feed motor 31, a head control circuit 63 for controlling the print heads 36, a captured image processing section 42 for processing images captured by the above-described CCD camera 40, the above-described pressure sensor 306, a pressure control circuit 314 for controlling the suction mechanism 16 described above according to the output value of the pressure sensor 306, the temperature sensor 322 described above, and the humidity sensor 324 described above.

In the color inkjet printer 20, the system controller 54 reads necessary information from the print data in the buffer memory 50, and based on this information, sends control signals to the main-scan drive circuit 61, the sub-scan drive circuit 62, and the head control circuit 63, for example. Also, the head control circuit 63 reads print data for the various color components from the image buffer 52 in accordance with the control signal from the system controller 54, and based on the print data, drives the nozzles for the various color provided in the print heads 36.

The system controller 54 also controls the suction blower 310 and the switch valve 312 according to the output value of the pressure sensor 306 using the pressure control circuit 314. Accordingly, the inside of the chamber is kept at a desired pressure, and suitable suction of the roll paper P can be achieved.

===Operation of the Printing System===

Figure 7:
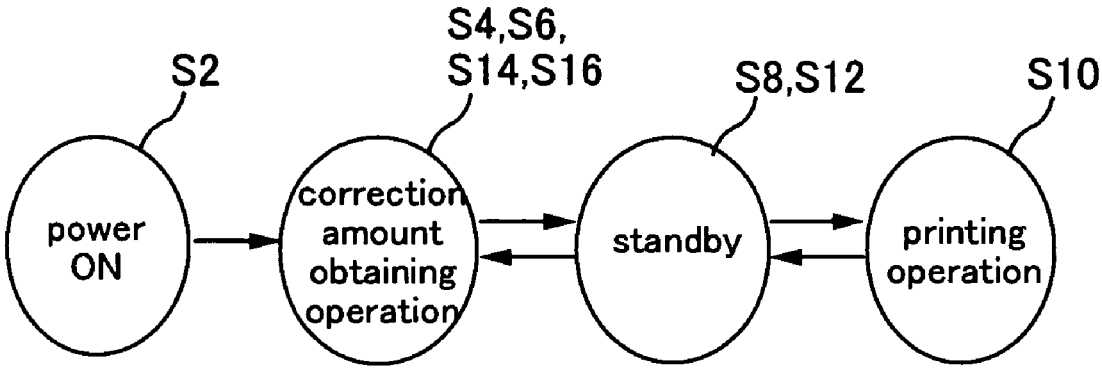
FIG. 7 is a transition diagram showing the operation of the printing system according to an embodiment of the present invention.

The operation of the above-described printing system is described next using FIG. 7. FIG. 7 is a transition diagram showing the operation of the printing system.

First, the user turns the power of the computer 90 and the power of the color inkjet printer 20 ON in order to supply power to the printing system (step S2).

After power has been supplied to the printing system and before an image is printed to the roll paper P, the color inkjet printer 20 carries out an operation for forming, on the roll paper P, dots for correcting the feed amount by which the paper feed roller 24 feeds the roll paper P (step S4). Then, based on the correction test pattern, which is a group of the dots thus formed on the roll paper P, the color inkjet printer 20 executes an operation for obtaining a correction amount for correcting the feed amount by which the roll paper P is fed (step S6). Herein after, these operations according to step S4 and step S6 may also be collectively referred to as the "correction amount obtaining operation".

Figure 8:
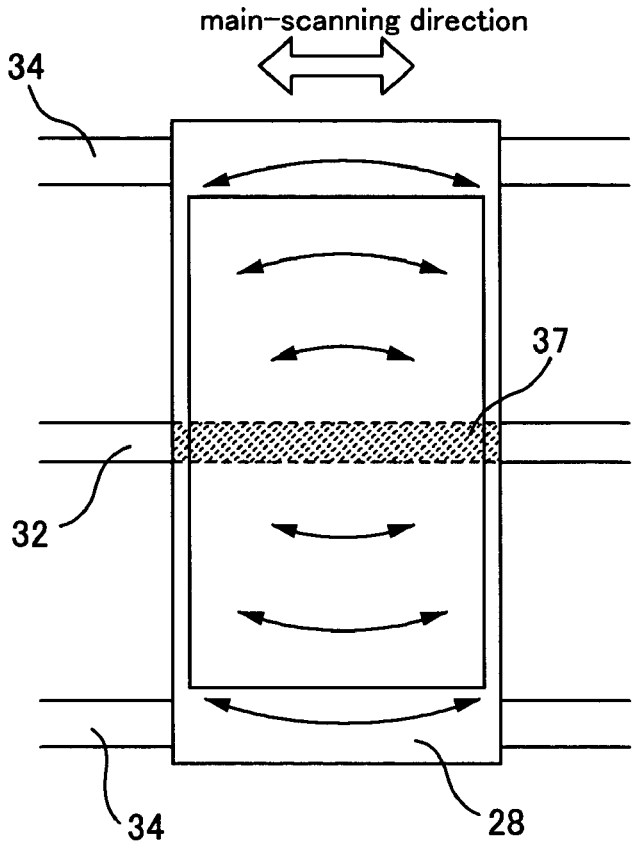
FIG. 8 is a conceptual diagram illustrating how vibration occurs when a carriage 28 is moved according to an embodiment of the present invention.
Figure 9:
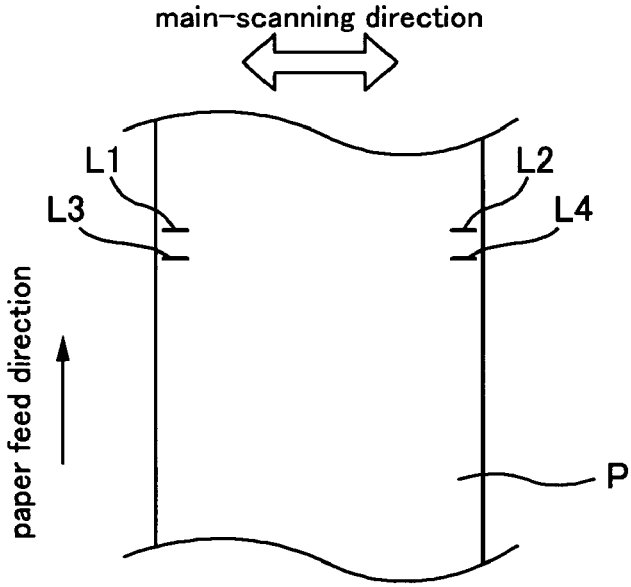
FIG. 9 is a conceptual diagram showing an example of a correction test pattern according to an embodiment of the present invention.

The operation of step S4 will be described using FIG. 8 and FIG. 9. FIG. 8 is a conceptual diagram illustrating how the vibration is generated when the carriage 28 is moved. FIG. 9 is a conceptual diagram showing an example of a correction test pattern.

First, the color injection printer 20 receives the above-mentioned command to turn on the power source, and print data PD about the correction test pattern is sent from the correction test pattern supply module 104 to the buffer memory 50 together with various commands COM. The image processing section 38 sends the print data PD to the image buffer 52 after receiving the data at the buffer memory 50.

The image processing section 38 also sends the above-described commands COM to the system controller 54 after they are received by the buffer memory 50. The system controller 54 then sends control signals to the main-scan drive circuit 61, the sub-scan drive circuit 62, and the head control circuit 63 based on the information received from the buffer memory 50 within the image processing section 38.

The head control circuit 63 reads the print data PD from the image buffer 52 within the image processing section 38 according to the control signals from the system controller 54. The head control circuit 63 then controls the print heads 36 based on the data that has been read out.

Then, while the sub-scan drive circuit 62 controls the paper feed motor 31 so that it feeds the roll paper P, the carriage motor 30 is controlled by the main-scan drive circuit 61 to move the carriage 28 in the main-scanning direction and the print heads 36 are controlled by the head control circuit 63 to eject ink, thereby forming, on the roll paper P, dots for correcting the feed amount by which the roll paper P is fed.

It should be noted that at this time, a print head 36, among the plurality of print heads 36 provided in/on the color inkjet printer 20, that is the least susceptible to the vibration caused by moving the carriage 28 is used as the print head 36 that is used when forming these dots onto the roll paper P.

In the present embodiment, this print head is the print head that is closest to the connecting section 37 between the carriage 28 and the pull belt 32. This is described using FIG. 8.

In FIG. 8, the carriage 28 is guided along the guide rail 34 and moved in the main-scanning direction (in the diagram, the direction shown by the white arrow). At this time, vibration occurs in the carriage 28 in the direction shown by the black arrows in the diagram. Also, since the carriage 28 is driven by the pull belt 32, the vibration becomes larger as the distance from the connecting section 37 becomes greater in the direction perpendicular to the main-scanning direction, as shown in the diagram.

Consequently, in this example, as shown in FIG. 1 and FIG. 2, the print head 36*c* is the print head that matches these conditions, and ink is ejected from the print head 36*c* to form, on the roll paper P, dots for correcting the feed amount by which the roll paper P is fed. It should be noted that the print heads 36 have not been shown in FIG. 8 in order to make the diagram easy to understand.

As described above, the color inkjet printer 20 feeds the roll paper P while moving the carriage 28 in the main-scanning direction and ejecting ink from a print head 36 to form, on the roll paper P, dots for correcting the feed amount by which the roll paper P is fed. The group of dots formed on the roll paper P then functions as a test pattern for correction. FIG. 9 shows an example of the dots that are formed. In FIG. 9, four transverse lines L1, L2, L3, and L4 are shown as the correction test pattern at the both edges of the roll paper P, and these are made of groups of dots lined up in the main-scanning direction.

The procedure through which these transverse lines L1, L2, L3, and L4 are formed is described next. First, the carriage 28 is moved in the main-scanning direction as ink is ejected from predetermined nozzles of the print head 36 to form the transverse line L1. Then, when the carriage 28 has arrived at a predetermined position, the ejection of ink is temporarily stopped. With the ejection of ink stopped, the carriage 28 is moved further in the main-scanning direction, and when the carriage 28 has arrived at a predetermined position, ink ejection starts again, and the transverse line L2 is formed.

After the transverse line L2 has been formed, the roll paper P is fed in the paper feed direction by a feed amount y. Then, while the carriage 28 is being moved in the main-scanning direction, ink is ejected from the nozzles used to form the transverse lines L1 and L2, forming the transverse line L3. Then, when the carriage 28 has reached a predetermined position, the ejection of ink is temporarily stopped. With ink ejection stopped, the carriage 28 is carried further in the main-scanning direction, and when the carriage 28 has reached a predetermined position, the ejection of ink is started again. Then, the transverse line L4 is formed.

Next, based on the correction test pattern formed on the roll paper P, the color inkjet printer 20 carries out an operation for obtaining a correction amount for correcting the feed amount by which the paper feed roller 24 feeds the roll paper P. (step S6).

This operation is described below. First, the color inkjet printer 20 moves the carriage 28 in the main-scanning direction and positions the carriage 28 in a position where both the transverse line L1 and the transverse line L3 can be captured by the CCD camera 40. Then, both the transverse line L1 and the transverse line L3 are captured by the CCD camera 40. Next, the color inkjet printer 20 moves the carriage 28 in the main-scanning direction and positions it in a position where the CCD camera 40 can capture both the transverse line L2 and the transverse line L4, and an image of both the transverse line L2 and the transverse line L4 is captured.

The two images captured in this way are sent to the captured image processing section 42, and both images undergo image processing. Then, from the result of this image processing, the distance between the transverse line L1 and the transverse line L3 is obtained as a feed amount Y1, and the distance between the transverse line L2 and the transverse line L4 is obtained as a feed amount Y2.

The information on the feed amount Y1 and the feed amount Y2 that have been obtained is sent to the system controller 54. The system controller 54 then calculates the average value Y of Y1 and Y2, and subtracts the above-mentioned feed amount y from the average value Y, obtaining a correction amount C (C=Y−y) for correcting the feed amount by which the paper feed roller 24 feeds the roll paper P. Then, this correction amount is set in the EEPROM 58 of the color inkjet printer 20.

It should be noted that in parallel with the above correction amount obtaining operation, or before or after this operation, the system controller 54 obtains data on the pressure inside the chamber 304 and the temperature and the humidity around the color inkjet printer 20 from the pressure sensor 306, the temperature sensor 322, and the humidity sensor 324, respectively. The data obtained are set in the EEPROM 58 of the color inkjet printer 20 together with the correction amount.

After the correction amount obtaining operation of step S4 and step S6 is over, the color inkjet printer 20 enters a standby state (step S8). In this embodiment, this standby state is a state in which the power is on and the correction amount obtaining operation or the printing operation is not being performed.

Then, in the standby state, the system controller 54 constantly obtains data on the on the pressure inside the chamber 304 and the temperature and the humidity around the color inkjet printer 20 from the pressure sensor 306, the temperature sensor 322, and the humidity sensor 324, respectively. These data that are obtained are compared with the data on the pressure, temperature, and humidity already stored in the EEPROM 58, and the differences between them is obtained. Then, if even one of the obtained difference in pressure, the obtained difference in temperature, and the obtained difference in humidity, exceeds a threshold value that has been respectively determined in advance, then the color inkjet printer 20 carries out the correction amount obtaining operation described above.

It should be noted that below, the description is continued under the premise that the correction amount obtaining operation is not performed in step S8.

Next, when an instruction to perform printing is made by the user in the application program 95, for example, the color inkjet printer 20 carries out the printing operation (step S10). The printing operation is described below.

Having received an instruction to perform printing, the application program 95 issues a print command. Then, the image processing section 38 mentioned above receives image data from the application program 95 and converts the data into print data PD, and the print data PD, together with various commands COMPUTER 90, are transmitted to the buffer memory 50. The image processing section 38 receives the print data PD through the buffer memory 50, and then sends the print data PD to the image buffer 52.

The image processing section 38 also receives the above commands COM through the buffer memory 50 and then sends them to the system controller 54. Based on the information received from the buffer memory 50 in the image processing section 38, the system controller 54 sends control signals to the main-scan drive circuit 61, the sub-scan drive circuit 62, and the head control circuit 63.

Also, the head control circuit 63 reads the print data for each of the various color components from the image buffer 52 in the image processing section 38 in accordance with the control signal from the system controller 54. Then, the head control circuit 63 controls the plurality of print heads 36*a*, 36*b*, 36*c*, 36*d*, 36*e*, 36*f*, 36*g*, and 36*h* according to the data that have been read out.

Then, while the sub-scan drive circuit 62 controls the paper feed motor 31 to feed the roll paper P, the main-scan drive circuit 61 controls the carriage motor 30 to move the carriage 28 in the main-scanning direction, and the head control circuit 63 controls the plurality of print heads 36*a*, 36*b*, 36*c*, 36*d*, 36*e*, 36*f*, 36*g*, and 36*h* to make them eject ink and print on the roll paper P. It should be noted that at this time, the operation of the paper feed motor 31 is corrected based on the correction amount that is stored in the EEPROM 58, that is, that has been set in the EEPROM 58 at step S6.

When the printing operation of the color inkjet printer 20 is over, the color inkjet printer 20 enters the standby state (step S12).

Then, as mentioned above, in the standby state, the system controller 54 constantly obtains data about the pressure within the chamber 304 and the temperature and the humidity around the color inkjet printer 20 from the pressure sensor 306, the temperature sensor 322, and the humidity sensor 324, respectively. These data that are obtained are compared with the data about the pressure, temperature, and humidity already stored in the EEPROM 58, and any difference between them is found. If even one of the obtained difference in pressure, the obtained difference in temperature, and the obtained difference in humidity, exceeds a threshold value that has been respectively determined in advance, then the color inkjet printer 20 carries out the correction amount obtaining operation described above.

It should be noted that in this embodiment, in step S12, the operation state of the printer has changed to the correction amount obtaining operation as a result of the type of the print paper being changed. A detailed description of this is as follows.

The user, in the standby state of step S12, changes the type of the print paper through the user interface display module 101. These instructions received through the user interface display module 101 are sent to the UI printer interface module 102 provided in the image processing section 38, and the UI printer interface module 102 interprets the order that has been instructed and sends a command COM to the buffer memory 50. The image processing section 38 receives this command COM and subsequently transmits it to the system controller 54.

The system controller 54 determines that the print paper type has been changed, and from the standpoint that the roll paper P is to be kept in a flat state, the controller 54 sets, to the pressure sensor control circuit 314, a value for the pressure within the chamber 304 that is adequate for the new type of print paper. Then, the pressure sensor control circuit 314 controls the suction mechanism 16 so that the pressure within the chamber 304 becomes the pressure value that has been set.

As a result of this control, the output value of the pressure sensor changes, and if that change is large, then the color inkjet printer 20 starts executing the correction amount obtaining operation. Then, in the correction amount obtaining operation, the same operations as those described in step S4 and step S6 are executed (step S14 and step S16), and a new correction amount is set in the EEPROM 58. The new correction amount that has been set is used for controlling the operation of the paper feed motor 31 in the printing operation that is performed next.

In this manner, ink is ejected from the print head, among the plurality of print heads, that is the least susceptible to the vibration generated when the carriage is moved, to form, on the roll paper, dots for correcting the feed amount by which the roll paper is fed by the paper feed roller as the carriage is moved, thereby allowing the feed amount to be suitably corrected.

That is, as described in the Description of the Related Art, when dots for correcting the feed amount are formed on the roll paper as the carriage is moved, vibration occurs in the carriage. Since the print heads are provided on the carriage, that vibration is also transmitted to the print heads.

Under these circumstances, when dots for correcting the feed amount are formed on the print paper by ejected ink from the print heads, a desired correction test pattern cannot be obtained, and consequently, there is a possibility that the correction amount obtained based on this correction test pattern will be inaccurate. Thus, when the feed amount is corrected based on this correction amount, appropriate correction can no longer be executed.

Accordingly, as above, ink is ejected from the print head of the plurality of print heads that is the least susceptible to the vibration generated when the carriage is moved, to form, on the roll paper, dots for correcting the feed amount by which the roll paper is fed by the paper feed roller as the carriage is moved.

Thus, if ink is ejected from the print head that is the least susceptible to the vibration, which is caused by moving the carriage, to form, on the print paper, dots for correcting the feed amount, then since the vibration has less of an impact, a desired correction test pattern is obtained, and consequently, the correction amount that is obtained based on that correction test pattern becomes accurate. Then, when the feed amount is corrected based on this correction amount, adequate correction of the feed amount can be implemented.

It should be noted that in the above discussion, the number of print heads was set to eight; however, this is not a limitation, and as long as the number is plural, there may be any number of print heads.

Also, in the above description, the correction test pattern formed on the roll paper was captured with the CCD camera and image processing was carried out in order to obtain a suitable correction amount; however, this is not a limitation, and for example, it is also possible to form a plurality of correction test patterns on the roll paper and for the user to select from these patterns a suitable correction test pattern so as to obtain a suitable correction amount.

Also, in the above description, a correction test pattern was formed on the roll paper by ejecting ink from a print head, and after finishing this process, that correction test pattern was captured by the CCD camera. This is not a limitation, however, and it is for example also possible to form a correction test pattern on the roll paper by ejecting ink from a print head while the CCD camera, which is adjacent to that print head, captures an image of the correction test pattern.

Also, in the above description, the image processing section shown in FIG. 6 was used as an example of a image processing means; however, this is not a limitation, and any means may be adopted, as long as it processes images output by an application, for example, in order to carry out operations such as to send print data to the head control circuit. For example, it is not necessary for the color conversion table to always be referenced when the color conversion module performs color conversion, and it is also not necessary for halftone processing to always be performed when image processing is carried out. It is also possible for the image processing means to not include a function as a user interface, such as the UI printer interface module.

Also, in the above description, the print mode was determined from the dot recording mode that was selected and the information on the resolution found in the print data PD. This is not a limitation, however. For example, it is also possible for the print mode to be determined based on only one of either the dot recording mode or the resolution. In the above description, a high image quality mode and a fast mode were described as the dot recording modes, but this is not a limitation.

Also, a correction test pattern that is made of a group of dots lined up in the main-scanning direction was shown in the above description, but it is also possible for the correction test pattern to be made of dots.

Other Embodiments

An embodiment of a printing apparatus, for example, according to the present invention has been described above. However, the foregoing embodiment of the invention is for the purpose of elucidating the present invention and is not to be interpreted as limiting the present invention. The invention can of course be altered and improved without departing from the gist thereof and includes functional equivalents.

It should be noted that in the above embodiment, print paper was described as the medium to be printed, but as the medium to be printed it is also possible to use film, cloth, or thin metal plates, for example. Also, roll paper was described as an example of the print paper, but it is also possible to use A0 paper or B0 paper, for example, as the print paper.

Also, in the above embodiment a color inkjet printer was described, but the present invention is also applicable for monochrome inkjet printers as well.

Also, in the above embodiment, ink was ejected from the print head located the closest to the connecting section between the carriage and the pull belt while the carriage was moved so as to form, onto the roll paper, dots for correcting the feed amount by which the paper feed roller feeds the roll paper. However, this is not a limitation.

In this case, however, the print head that is the least susceptible to vibration can be easily selected from among the plurality of print heads, and in this regard the above-described embodiment is preferable.

Also, in the above embodiment, ink was ejected from a print head while the carriage was moved so as to form, on both edge sections of the roll paper, dots for correcting the feed amount. However, this is not a limitation, and for example, it is also possible for ink to be ejected from a print head while the carriage is moved so as to form dots for correcting the feed amount on only one edge section of the roll paper.

In the case of the above-mentioned embodiment, however, two groups of correction test patterns can be obtained, thereby allowing the correction amount to be obtained more accurately. Therefore, from the standpoint that more suitable correction can be carried out, the embodiment described above is more preferable.

Also, in the above embodiment, ink is ejected from predetermined nozzles provided in the predetermined print head to form dots for correcting the feed amount on the roll paper; however, this is not a limitation. For example, it is also possible to change the nozzles that eject ink every time dots for correcting the feed amount are formed on the roll paper.

However, from the standpoint that error due to changing the nozzles that eject ink does not occur, the configuration of the above-mentioned embodiment is preferable.

Also, in the above embodiment, whether or not to form, onto the roll paper, the dots for correcting the feed amount by which the print paper is fed by the paper feed roller was determined according to the output value of the pressure sensor. However, this is not a limitation.

When, however, the force by which the roll paper is sucked by the suction mechanism fluctuates, the friction of the roll paper against the platen also fluctuates, and therefore there is a higher possibility that the correction amount appropriate for correcting the feed amount will change.

Consequently, from the perspective that dots for correcting the feed amount by which the roll paper is fed by the paper feed roller are formed on the roll paper at an appropriate timing, the above-mentioned embodiment is preferable.

Also, in the above embodiment, whether or not to form the dots for correcting the feed amount, by which the paper feed roller feeds the roll paper, onto the roll paper was determined according to at least one of the temperature value and the humidity value around the color inkjet printer. However, this is not a limitation.

When, however, the temperature or the humidity around the color inkjet printer fluctuates, the roll paper will expand/constrict or the above-described friction may fluctuate, and therefore there is a high possibility that the correction amount appropriate for correcting the feed amount will change.

Consequently, from the perspective that dots for correcting the feed amount by which the roll paper is fed by the paper feed roller are formed on the roll paper at an appropriate timing, the above embodiment is preferable.

Also, in the above embodiment, the dots for correcting the feed amount by which the roll paper is fed by the paper feed roller are formed on the roll paper when power is supplied to the color inkjet printer. However, this is not a limitation. For example, it is also possible for dots for correcting the feed amount by which the roll paper is fed by the paper feed roller to not be formed on the roll paper when power is supplied to the color inkjet printer.

However, from the standpoint that execution of appropriate correction can be guaranteed, the embodiment described above is preferable.

It is also possible for dots for correcting the feed amount by which the roll paper is fed by the paper feed roller to be formed on the print paper during the printing operation of the color inkjet printer.

For example, if those dots may be formed on the print paper when a new page is printed, or if a plurality of sheets of print paper are printed continuously, then it is possible for those dots to be formed on the print paper each time a predetermined number of sheets of the print paper have been printed.

Doing this allows the dots to be formed on the print paper efficiently.

It is also possible to form dots for correcting the feed amount, by which the roll paper is fed by the paper feed roller, onto the print paper when the print paper has been exchanged.

Doing this allows execution of suitable correction to be guaranteed.

It is also possible to provide the color inkjet printer with a detector (second detector) for detecting whether or not the print paper has been exchanged, and when it is detected by the detector that the print paper has been exchanged, the dots for correcting the feed amount by which the paper is fed by the paper feed roller may be formed on the print paper.

For example, a reflective-type optical sensor can be used as the detector, in which case the light that is emitted from the reflective-type optical sensor toward the print paper is reflected by the print paper and the intensity of that reflected light is measured in order to detect whether or not the print paper has been exchanged.

Accordingly, whether or not the print paper has been exchanged can be detected using a simple method.

It is also possible for the dots for correcting the feed amount by which the roll paper is fed by the paper feed roller to be formed on the print paper when the print mode, which was discussed above, of the color inkjet printer has been changed.

Since the paper feed amount is different for each print mode, this would ensure execution of appropriate correction.

Also, in the above embodiment, a plurality of correction amounts for correcting the feed amount by which the roll paper is fed by the paper feed roller were obtained based on the dots formed on the roll paper, and based on the average value of the plurality of correction amounts that were obtained, the feed amount by which the roll paper is fed by the paper feed roller was corrected. However, this is not a limitation. For example, it is also possible to obtain a single correction amount for correcting the feed amount by which the roll paper is fed by the paper feed roller based on the dots formed on the roll paper, and based on the correction amount that is obtained, the feed amount by which the roll paper is fed by the paper feed roller can be corrected.

However, from the perspective that more accurate correction can be carried out in the present case, the configuration of the above embodiment is preferable.

With the present invention, it is possible to achieve a printing apparatus with which correction of the feed amount can be suitably carried out.

Although the preferred embodiment of the present invention has been described in detail, it should be understood that various changes, substitutions and alterations can be made therein without departing from spirit and scope of the inventions as defined by the appended claims.

What is claimed is:

1. A printing apparatus comprising:

a plurality of print heads;

a moving member that moves along a main-scanning direction and that is provided with said plurality of print heads;

a feed mechanism that feeds a medium to be printed; and a drive member that is connected to said moving member at a connecting section and that drives said moving member along the main-scanning direction;

a controller that makes a predetermined print head, among said plurality of print heads, eject ink to form dots for correcting a feed amount by which said feed mechanism feeds said medium to be printed are formed on said medium to be printed, while moving said moving member, said predetermined print head being a print head other than the print head that is the furthest away from said connecting section in a direction perpendicular to the main-scanning direction, among said plurality of print heads;

wherein each of said plurality of print heads has a black nozzle row, a cyan nozzle row, a magenta nozzle row, and a yellow nozzle row.

2. A printing apparatus according to claim 1, wherein said predetermined print head is the print head, among said plurality of print heads, that is the least susceptible to the vibration caused by moving said moving member.

3. A printing apparatus according to claim 1, further comprising:

wherein said predetermined print head is the print head that is located the closest to a connecting section at which said moving member and said drive member are connected to each other.

4. A printing apparatus according to claim 3, wherein the dots for correcting the feed amount by which said feed mechanism feeds said medium to be printed are formed on edge sections of said medium to be printed by ejecting ink from said predetermined print head, among said plurality of print heads, while moving said moving member.

5. A printing apparatus according to claim 1, wherein the dots for correcting the feed amount by which said feed mechanism feeds said medium to be printed are formed on said medium to be printed by ejecting ink from predetermined nozzles provided in said predetermined print head.

6. A printing apparatus according to claim 1, wherein whether or not to form, on said medium to be printed, the dots for correcting the feed amount by which said feed mechanism feeds said medium to be printed is determined according at least one of:

a value of a temperature around said printing apparatus and a value of a humidity around said printing apparatus.

7. A printing apparatus according to claim 1, wherein the dots for correcting the feed amount by which said feed mechanism feeds said medium to be printed are formed on said medium to be printed when power is supplied to said printing apparatus.

8. A printing apparatus according to claim 1, wherein the dots for correcting the feed amount by which said feed mechanism feeds said medium to be printed are formed on said medium to be printed during a printing operation of said printing apparatus.

9. A printing apparatus according to claim 1, wherein the dots for correcting the feed amount by which said feed mechanism feeds said medium to be printed are formed on said medium to be printed when said medium to be printed has been exchanged.

10. A printing apparatus according to claim 9, further comprising:

a detector for detecting whether or not said medium to be printed has been exchanged;

wherein when it has been detected by said detector that said medium to be printed has been exchanged, the dots for correcting the feed amount by which said feed mechanism feeds said medium to be printed are formed on said medium to be printed.

11. A printing apparatus according to claim 1, wherein the dots for correcting the feed amount by which said feed mechanism feeds said medium to be printed are formed on said medium to be printed when a print mode of said printing apparatus has been changed.

12. A printing apparatus according to claim 1, wherein at least two correction amounts for correcting the feed amount by which said feed mechanism feeds said medium to be printed are obtained based on said dots formed on said medium to be printed, and wherein, based on an average value of said correction amounts that are obtained, the feed amount by which said feed mechanism feeds said medium to be printed is corrected.

13. A printing apparatus according to claim 1, further comprising:

a detector for detecting whether or not said medium to be printed has been exchanged;

wherein when it has been detected by said detector that said medium to be printed has been exchanged, the dots for correcting the feed amount by which said feed mechanism feeds said medium to be printed are formed on said medium to be printed.

14. The printing apparatus according to claim 1, wherein the driving member extends along the moving member in the main scanning direction.

15. A printing apparatus comprising:

a plurality of print heads;

a moving member that can be moved and that is provided with said plurality of print heads; and a feed mechanism for feeding a medium to be printed;

a support member for supporting said medium to be printed; a suction member for sucking said medium to be printed toward said support member; and a first detector for detecting a force by which said suction member sucks said medium to be printed;

wherein dots for correcting a feed amount by which said feed mechanism feeds said medium to be printed are formed on said medium to be printed by ejecting ink from a predetermined print head, among said plurality of print heads, while moving said moving member, and wherein said predetermined print head is a print head other than the print head, among said plurality of print heads, that is the most susceptible to vibration caused by moving said moving member, wherein whether or not to form, on said medium to be printed, the dots for correcting the feed amount by which said feed mechanism feeds said medium to be printed is determined according an output value of said first detector.

16. A printing apparatus comprising:

a plurality of print heads;

a moving member that can be moved and that is provided with said plurality of print heads; and a feed mechanism for feeding a medium to be printed;

wherein dots for correcting a feed amount by which said feed mechanism feeds said medium to be printed are formed on both edge sections of said medium to be printed by ejecting ink from a predetermined print head, among said plurality of print heads, while moving said moving member;

wherein said predetermined print head is the print head, among said plurality of print heads, that is the least susceptible to vibration caused by moving said moving member;

wherein said printing apparatus further comprises a drive member that is connected to said moving member and that is for driving said moving member;

wherein said predetermined print head is the print head that is located the closest to a connecting section at which said moving member and said drive member are connected to each other; wherein said printing apparatus further comprises:

a support member for supporting said-medium to be printed;

a suction member for sucking said medium to be printed toward said support member; and a detector for detecting a force by which said suction member sucks said medium to be printed;

wherein whether or not to form, on said medium to be printed, the dots for correcting the feed amount by which said feed mechanism feeds said medium to be printed is determined according an output value of said detector; and wherein whether or not to form, on said medium to be printed, the dots. for correcting the feed amount by which said feed mechanism feeds said medium to be printed is determined according at least one of a value of a temperature around said printing apparatus and a value of a humidity around said printing apparatus.

* * * * *